United States Patent [19]

Elphick

[11] 4,450,914

[45] May 29, 1984

[54] WELL TREATMENT VALVE

[75] Inventor: James Elphick, Dallas, Tex.

[73] Assignee: Dresser Industries, Inc., Dallas, Tex.

[21] Appl. No.: 342,550

[22] Filed: Jan. 25, 1982

[51] Int. Cl.[3] ..... E21B 34/00

[52] U.S. Cl. ..... 166/325; 166/222

[58] Field of Search ..... 166/321-325, 166/222

[56] References Cited

U.S. PATENT DOCUMENTS

| | | | |
|---|---|---|---|
| 1,767,538 | 6/1930 | Mahan . | |
| 2,327,051 | 8/1943 | Lyons et al. | 166/222 |
| 3,086,591 | 4/1963 | Sexton | 166/222 |
| 3,583,481 | 6/1971 | Vernotzy | 166/321 |
| 3,713,490 | 1/1973 | Watson | 166/305 |
| 3,802,507 | 4/1974 | Watson | 166/154 |
| 3,884,300 | 5/1975 | Garrett | 166/324 |
| 3,987,848 | 10/1976 | Canterbury | 166/224 |
| 3,993,129 | 11/1976 | Watkins | 166/319 |
| 4,036,297 | 7/1977 | Swihart | 166/325 |
| 4,063,594 | 6/1976 | Canterbury | 166/325 |
| 4,260,020 | 4/1981 | Nelson | 166/325 |

*Primary Examiner*—William F. Pate, III

*Attorney, Agent, or Firm*—William R. Peoples

[57] ABSTRACT

A well treatment valve includes spring means within a spring chamber acting against an actuating rod movable against a valve body to open and close the valve. The spring means is sealed against pressure in an inlet to the valve while a passage communicates between the valve inlet and the spring chamber. The spring means is a gas spring.

10 Claims, 2 Drawing Figures

WELL TREATMENT VALVE

TECHNICAL FIELD

This invention relates to a well treatment valve such as typically may be used in acidizing a well to improve the production of oil from the well.

BACKGROUND ART

The acidizing of a well is a conventional process employed to enhance production of oil from a well by using an acid to increase the permeability of the oil bearing formation adjacent a perforated section of the well casing. For example, in a well whose productivity has been diminished by reduced permeability owing to the build-up of an insoluble residue at the casing-formation interface, a retarded acid such as acetic acid or formic acid may be used to dissolve the residue thereby making it easier for oil to flow from the formation into the casing.

In treating a well with acetic acid, a tubing work string carrying a well treatment valve is run into the well until the valve is located adjacent the area of the formation to be treated. A predetermined amount of the acid is then spotted in the casing by being pumped down the tubing through the valve and into the casing adjacent the perforations. A packer is then set between the tubing and the casing above the acid, and the acid thereafter is squeezed into the formation by pressurizing the tubing string. When the tubing pressure is relieved, the valve closes and the acid is shut-in the formation for some period of time and allowed to react with the residue. Thereafter, a second flow path by-passing the valve may be opened and fluid pumped from the well to remove the spent acid. The work string thereafter may be pulled from the well and replaced with a production string.

One form of a prior well treatment valve is shown in U.S. Pat. No. 3,713,490 and a similar valve is shown in U.S. Pat. No. 3,987,848. Both of these treatment valves, however, function in a manner similar to that of a conventional check valve so that, when the pressure differential across the body of the valve reaches some predetermined magnitude, the valve will open. Unfortunately, during the shut-in time with this type of valve the valve body may shift to an open position allowing tubing fluid to flow through the valve if the well goes on a vacuum i.e. when pressure in the well fluid drops significantly relative to the pressure head of the fluid in the tubing string. This may occur when the the formation pressure is less than the pressure head of this fluid in the well so that as the acid works, increasing permeability at the casing-formation interface, the well fluid and fluid from the tubing may flow back into the formation carrying with it some of the acid intended to act on the residue in the zone adjacent the casing. This, of course, may reduce the intended effectiveness of the acid on the residue.

DISCLOSURE OF INVENTION

The present invention contemplates an improved well treatment valve which positively remains closed during the shut-in time of the acidizing process regardless of any changes that might occur in the pressure differential existing across the valve. More specifically, the present invention aims to construct the valve so that the resultant closing forces acting on the valve are virtually constant downhole and are reacted against solely by tubing pressure thereby substantially eliminating the effect of the well fluid pressure on the opening of the valve. Accordingly, the present invention resides in the provision of a sealed chamber isolated from both tubing and well fluids and including a sealed actuating rod extending therefrom with means within the sealed chamber for urging the rod toward engagement with the valve body or closure member to hold the latter against its seat so as to close the valve. More particularly, the invention resides in utilizing a gas spring device as the means for urging the actuating rod, with the gas spring located in a tubing-vented chamber and the actuating rod passing through seal means between the vented chamber and an outlet chamber for the valve and with the rod having an effective pressure area not substantially less than the effective pressure area across the valve body. By virtue of this construction, actuator rod is isolated from upwardly directed tubing pressure forces so that the valve may be opened simply by increasing tubing pressure and yet is unaffected by changes in well fluid pressure while the well is shut-in.

The foregoing and other advantages of the present invention will become more apparent from the following description of the best mode of carrying out the invention when taken in conjunction with the accompanying drawings.

BEST MODE OF CARRYING OUT THE INVENTION

Figure 2:
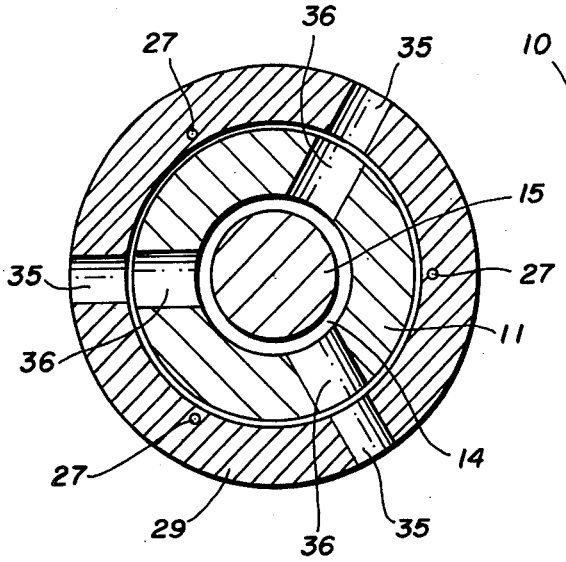
FIG. 2 is an enlarged cross-sectional view taken substantially along line 2—2 of FIG. 1.
Figure 1:
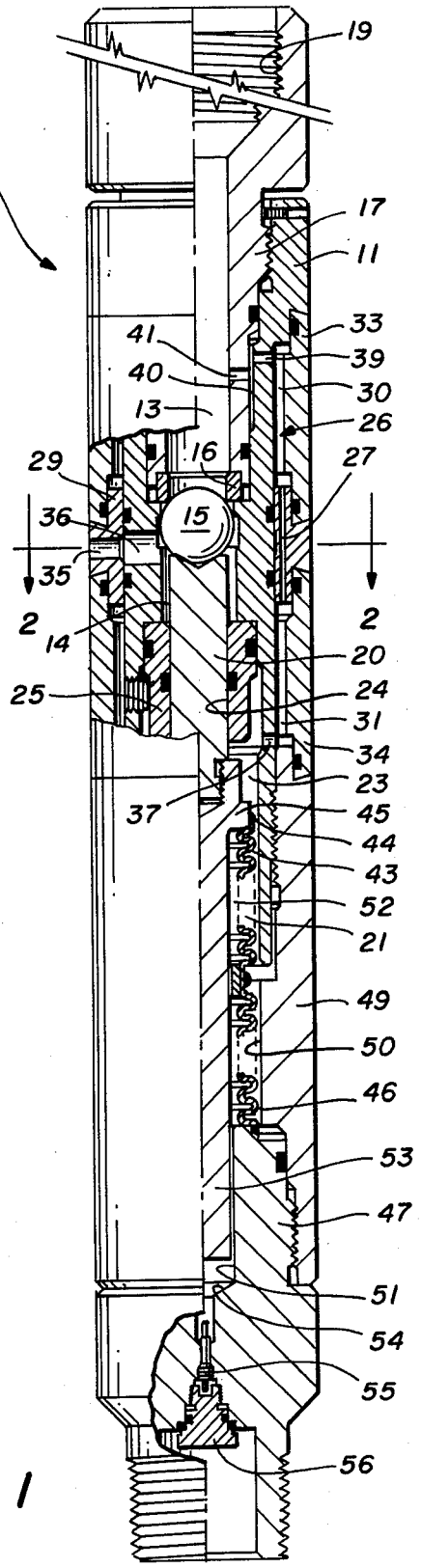
FIG. 1 is a combined cross-sectional and elevational view of a well treatment valve embodying the novel features of the present invention.

As shown in the drawings for purposes of illustration, the present invention is embodied in a well treatment valve 10 such as may be attached to the end of a tubing string (not shown) and used to control the delivery of a well treatment fluid to an oil bearing formation to help increase production from the well. For example, production from a formation may diminish over time within a well as a result of a build-up of an impermeable residue in a relatively thin zone immediately outside of the well casing perforations and treatment of the formation with an acid such as acetic acid may increase the permeability of the zone, thereby in turn increasing the production of oil from the well. Herein, the well treatment valve 10 comprises a tubular housing 11 with an inlet chamber 13 within the upper end portion thereof. Intermediate the ends of the housing is an outlet chamber 14 for communication to the outside of the valve and a valve closure member or body 15 in the form of a ball is urged against an annular valve seat 16 located between the two chambers. The valve seat is captivated against annular shoulder within the housing by means of a tubular seat retainer 17 which is telescoped into upper end portion of the housing and the retainer includes an internally threaded upper section 19 for connection to the tubing string within which the valve is to be placed.

Pushing the valve body 15 against the seat 16 is an actuator rod 20 which is urged upwardly by spring means 21 confined within a spring chamber 23. The latter is located beneath the outlet chamber 14 generally within the lower end portion of the housing. The actuator rod extends through a bore 24 in a sealing member 25 mounted between the outlet and spring chambers 14 and 23 so as to seal one from the other. Extending between the inlet and spring chambers 13 and 23 are pressure passages 26 which provide fluid communication between these two chambers so the pressures in the chambers are substantially the same. Preferably, herein, there are three of the pressure passages 26 (see FIG. 2) comprising equiangularly spaced vent passages 27 extending through a cross-over ring 29 which surrounds the housing 11 laterally of the outlet chamber 14. The vent passages communicate with upper and lower annular spaces 30 and 31 formed between the exterior of the housing 11 and upper and lower sections 33 and 34 of tubular retainer means captivating the cross-over on the housing. Located in the cross-over 29 in the spaces between the vent passages 27 are casing ports 35 which are in registry with somewhat larger diameter outlet ports 36 in the housing 11 so as to provide fluid communication between the outlet chamber 14 and the outside of valve.

At the lower end of the lower annular space 31, a lower venting port 37 provides communication through the housing 11 to the spring chamber 23 and, at the upper end of the upper annular space 30 an upper venting port 39 is formed through the housing. Preferably, herein, the latter port 39 communicates with a debris chamber 40 defined by a sealed annular space formed between the housing 11 and the seat retainer 17. An inlet port 41 through the seat retainer communicates between the inlet chamber 13. Advantageously, the inlet port 41 is spaced below the upper venting port 39 and the debris chamber 40 extends both downwardly from the inlet port 41 and upwardly to the upper venting port 39 so that in service use, debris in fluid flowing from the inlet port toward the spring chamber 23 tends to collect in the debris chamber rather than at some location in the pressure passage 26 which would tend to block off pressure communication between the inlet chamber 13 and the spring chamber 23.

In using the exemplary valve 10, the latter is attached to a tubing string (not shown) and lowered into a well to a position within the casing adjacent a treatment zone in a formation. Typically, the tubing string is run into the well dry and once the valve is located as desired, a predetermined quantity of treatment fluid is pumped down the tubing string under pressure, shifting the valve body 15 off its seat 16 for the treatment fluid to be spotted in the casing adjacent the formation zone to be treated. Thereafter, a packer is set above perforations in the casing between the casing and the tubing string allowing the tubing string and treatment fluid in the casing to be forced under pressure into the treatment zone. Once the squeezing pressure is retrieved, the actuator rod 20 is again urged upwardly, shifting the valve body 15 against the seat 16 to close the valve. When treating with a retarded acid, such as acetic acid, the well may be left shut-in for a period of time allowing the acid to soak within the zone being treated.

In accordance with the present invention, valve 10 is of a particularly novel construction so as to keep the valve body 15 in its closed position even if the well were to go on vacuum and thereby keeping fluid in the tubing string from flowing into the formation and detrimentally affecting the treatment of the zone. For this purpose, the actuating rod 20 is mounted within the housing 11 so as to eliminate the effect of the pressure head in the well fluid and rely solely on the spring means to close the valve. More specifically, the spring means 21 is separate from the fluid pressure in the tubing string and urges the rod 20 toward closing the valve with the tubing string pressure acting in a direction toward opening the valve. Herein, the actuating rod 20 is mounted within the housing 11 and is sealed against the tubing string pressure acting in a direction toward holding the valve body in closed position. By virtue of this arrangement, even if the well were to go on vacuum, the valve is kept from opening because opening of the valve is independent of the pressure differential existing between the inlet and outlet chambers 13 and 14.

In the present instance, the spring means comprises a gas spring 21 including an expandable metallic bellows 43 within the spring chamber 23. An upper end 44 of the bellows is sealingly connected with the actuating rod 20, specifically being connected to a rod extension 45 which serves as a stroke limiting piston to prevent excessive compression of the bellows in service use. A lower end 46 of the bellows is similarly sealingly connected to a gas spring body 47 which, in turn, is attached to the housing 11 by way of threaded connections through a tubular bellows guide 49. The latter, at least in part, defines a portion of the spring chamber 23 and includes an interior annular well section 50 for guiding and limiting movement of the bellows within the spring chamber. Within the gas spring, body 47, a lower recess 51 receives lower end portion 53 of the stroke limiting piston 45 and the end 54 of the recess serves as a stop limiting shoulder to prevent over compression of the bellows. In use, the interior of the bellows defines a high pressure chamber 52 and is charged through an inlet valve 55 to a preselected high pressure so as to shift the valve body 15 into its closed position against the pressure head of fluid expected in the tubing string for the depth of well to be treated. Thus, it will be appreciated that the valve closing may be adjusted selectively for treatment of formations of different depths. A sealing cap 56 within the spring body 47 over the inlet valve 55 protects against the leakage of pressure fluid from within the bellows.

More specifically, herein, the bellows has an effective cross-sectional pressure area which is larger than the effective pressure area of the valve body 15 in its closed position and, because the rod 20 is sealingly connected with the high pressure interior of the bellows 43, a differential piston effect is produced upon the rod by the pressure existing in the tubing string with both fluid pressure in the inlet chamber 13 acting on the valve body 15 and fluid pressure in the spring chamber 23 acting accumulatively on the actuating rod 20 to move the latter in an opening direction. Advantageously, on the other hand, the effective pressure area of the actuating rod 20 through the sealing member 25 is the same as the aforementioned effective pressure area of the valve body 15 in its closed position. Accordingly, in the closed position of the valve body, the effect of well fluid pressure existing in the outlet chamber 14 is balanced on the rod 20 with the net result being that the actuating rod is opened and closed only in response to the fluid pressure seen in the inlet chamber 13 as reacted against by the pressure of the gas spring 21. By virtue of the arrangement, even if action of the treatment fluid in the treatment zone may cause a pressure drop in the well fluid beneath the packer, the valve body 15 will not open and drain excess fluid from the tubing string into the formation.

The embodiments of the invention in which an exclusive property or privilege is claimed are defined as follows:

1. A well treatment valve for use in acidizing a well including:

a valve housing with inlet and outlet chambers, a valve seat disposed within said housing between said inlet and outlet chambers, a valve body within said housing and movable relative to said seat between open and closed positions, a spring chamber associated with said housing but sealed against fluid communication with said outlet chamber, a pressure passage communicating between said inlet chamber and said spring chamber, a bore extending between said outlet chamber and said spring chamber, an actuating rod with a lower end portion disposed within said spring chamber and an upper end portion extending through and pressure sealed within said bore for engagement with said valve body, a high pressure chamber sealed within said spring chamber and charged to a preselected high pressure, said lower end portion of said actuating rod effectively extending into said high pressure chamber and being urged by the pressure therein toward said engagement with said valve body to close said valve, and means for effectively sealing between said lower end portion of said actuating rod and said high pressure chamber so that movement of said actuating rod may be controlled virtually exclusively by varying the pressure in said inlet chamber relative to the charged pressure in said high pressure chamber.

2. A well treatment valve as defined by claim 1 wherein said means for effectively sealing between said actuating rod and said high pressure chamber comprises a bellows.

3. A well treatment valve as defined by claim 1 or 2 wherein the effective cross-sectional area of said actuating rod as sealed within said bore is substantially equal to the cross-sectional area of said valve body affected by pressure in said inlet chamber when said body is in its closed position.

4. A well treatment valve as defined by claim 1 or 2 wherein the effective cross-sectional area of said actuating rod sealed within said bore is at least as great as the cross-sectional area of said valve body affected by pressure in said inlet chamber when said body is in its closed position.

5. A well treatment valve as defined by claim 3 wherein said bellows has an effective diameter at least as large as the diameter of said valve body affected by said chamber pressure.

6. A well treatment valve as defined by claim 5 wherein said bellows has an effective diameter larger than the diameter of said valve body affected by said inlet chamber pressure.

7. A well treatment valve as defined by claim 5 including a debris chamber within said pressure passage.

8. A well treatment valve for use in acidizing a well, including:

a valve housing with inlet and outlet chambers, a valve seat disposed within said housing with an opening between said inlet and outlet chambers, a tubular seat retainer telescoped into said housing and against said seat, a valve body disposed within said outlet chamber and movable relative to said seat to open and close said opening, a spring chamber associated with said housing but sealed against fluid communication with said outlet chamber, a pressure passage communicating between said inlet chamber and said spring chamber and defined by, an inlet port through said seat retainer, a debris chamber between said seat retainer and said housing, an upper venting port through said housing located above said inlet port, crossover means on said housing and having a vent passage therethrough communicating with said upper venting port, and a lower venting port through said housing and communicating between said vent passage and said spring chamber, an outlet port through said housing and communicating with said outlet chamber, a casing port through said crossover means and aligned with said outlet port for fluid communication from said outlet chamber to the outside of said valve, a bore extending between said outlet chamber and said spring chamber, an actuating rod with a lower end portion disposed within said spring chamber and an an upper end portion extending through said bore for engagement with said valve body, a sealing member acting between said actuating rod and said bore against fluid communication therethrough between said outlet chamber and said spring chamber, a bellows sealed within said spring chamber and defining a high pressure chamber therewithin for being charged to a preselected high pressure, said actuating rod including an extension protruding into said high pressure chamber, and a shoulder within said high pressure chamber engageable by said extension to limit the extent of compression of said bellows by said actuating rod when the fluid pressure in said inlet chamber is increased to overcome the charge in said high pressure chamber to shift said valve body and open said opening.

9. A well treatment valve as defined by claim 8 wherein said opening and said actuating rod have substantially the same effective pressure areas and said bellows has a greater mean effective pressure area.

10. A well treatment valve for use in acidizing a well including:

a valve housing with inlet and outlet chambers, a valve seat disposed within said housing between said inlet and outlet chambers, a valve body within said housing and movable relative to said seat between open and closed positions, a spring chamber associated with said housing but sealed against fluid communication with said outlet chamber, a pressure passage communicating between said inlet chamber and said spring chamber, a bore extending between said outlet chamber and said spring chamber, an actuating rod with a lower end portion disposed within said spring chamber and an upper end portion extending through and pressure sealed within said bore for engagement with said valve body, a sealed pressure chamber within said spring chamber, said lower end portion of said actuating rod effectively extending into said sealed pressure chamber, spring means within said sealed pressure chamber for urging said actuating rod toward said engagement with said valve body to close said valve, and means for effectively sealing between said lower end portion of said actuating rod and said sealed pressure chamber so that movement of said actuating rod may be controlled virtually exclusively by varying the pressure in said inlet chamber relative to the force provided by said spring means and acting against said actuating rod.

* * * * *